US005497073A

United States Patent [19]

Böhme et al.

[11] Patent Number: 5,497,073

[45] Date of Patent: Mar. 5, 1996

[54] CONSTANT CURRENT SOURCE HAVING BAND-GAP REFERENCE VOLTAGE SOURCE

[75] Inventors: Rolf Böhme, Bad Friedrichshall; Wolfgang Eckstein, Obersulm-Sülzbach; Jens Wirth, Heilbronn, all of Germany

[73] Assignee: Temic Telefunken microelectronic GmbH, Heilbronn, Germany

[21] Appl. No.: 360,030

[22] Filed: Dec. 20, 1994

[30] Foreign Application Priority Data

Dec. 24, 1993 [DE] Germany ..... 43 44 447.4

[51] Int. Cl.[6] ..... G05F 3/04; G05F 3/16

[52] U.S. Cl. ..... 323/312; 323/313

[58] Field of Search ..... 323/312, 313, 323/314, 315; 327/535, 538, 539

[56] References Cited

U.S. PATENT DOCUMENTS

| | | | |
|---|---|---|---|
| 4,644,257 | 2/1987 | Bohme et al. | 323/313 |
| 4,733,161 | 3/1988 | Kuwahara | 323/315 |
| 4,785,231 | 11/1988 | Bohme et al. | 232/316 |
| 5,180,967 | 1/1993 | Yamazaki | 323/312 |
| 5,293,112 | 3/1994 | Takahashi | 323/312 |
| 5,391,979 | 2/1995 | Kajimoto et al. | 323/313 |
| 5,430,361 | 7/1995 | Whitlock et al. | 323/313 |

FOREIGN PATENT DOCUMENTS 3610158 1/1990 Germany .

*Primary Examiner*—Matthew V. Nguyen
*Attorney, Agent, or Firm*—Spencer & Frank

[57] ABSTRACT

A constant current source that has a band-gap reference voltage source with three transistors, where the third transistor is connected with the input of a current balancing circuit whose output controls current sources for the first and second transistors of the band-gap reference voltage source as well as a current source for generating a constant output current and which can be connected via a resistor both with the operating voltage source and with the reference potential by the use of a switch. This circuit results in a low power consumption because it is switched on by the use of a switch only when required and in the switched-off state draws a minimum amount of leakage current.

4 Claims, 3 Drawing Sheets

CONSTANT CURRENT SOURCE HAVING BAND-GAP REFERENCE VOLTAGE SOURCE

BACKGROUND OF THE INVENTION

The invention relates to a constant current source with a first and a second controlled current source, a first, a second and a third transistor, and a first resistor, where the base of the second transistor is connected to the collector of the first transistor, the emitter of the first transistor is at the reference potential of the circuit, the first controlled current source is connected to the base of the first transistor, the second controlled current source is connected to the collector of the second transistor, which in turn is connected to the base of the third transistor, and where either the first resistor connects the base of the first transistor with its collector and the emitter of the second transistor is at reference potential or the first resistor connects the emitter of the second transistor with the reference potential and the base of the first transistor is connected directly to its collector. A constant current source of this kind is known from DE 36 10 158.

The constant current source described in DE 36 10 158, especially FIG. 4, includes a band-gap reference voltage source with which a constant current is generated. A band-gap circuit of this kind is generally made in integrated-circuit technology supplying an output voltage that remains substantially constant with variations in temperature. Use is made here of a specific transistor base-emitter voltage $V_{BE}$ characteristic that varies with temperature by employing a first transistor operated as diode and a second transistor with different emitter current intensities in order to create a voltage across a first resistor that is proportional to the difference between the respective base/emitter voltages $V_{BE}$. This differential voltage has a positive temperature coefficient and consequently also the current flowing through the first resistor. With the help of a current balancing circuit, this current is copied into an output circuit. In DE 36 10 158 it is demonstrated how the temperature coefficient of this output current can be brought to zero by one or two additional resistors.

The generation of a temperature-independent output voltage is also known, by conducting the current through a series circuit comprising a diode and a resistor.

The above-mentioned known constant current source includes a starting circuit which activates and keeps active the constant current source when a supply voltage is applied.

With regard to a low power consumption, it is useful in some applications to be able to switch off the constant current source when required.

SUMMARY OF THE INVENTION

The object of the invention is to specify a constant current source of the type named at the outset that can be switched both on and off when supply voltage is applied and which also features an excellent low power consumption.

According to the invention the collector of the third transistor, belonging to the band-gap reference voltage source, is connected to the input of a current balancing circuit whose output controls three current sources. The first two current sources respectively supply the first and second transistors of the band-gap reference voltage source and the third current source generates the desired constant current at a load. Furthermore, the output of the current balancing circuit can be connected via a resistor either with the reference potential, causing the current source to be activated, or it can be set to the operating potential of the circuit, causing the current source to become inactive. This constant current source according to the invention allows the constant current function to be switched on and off when supply voltage is applied, and in the switched off state in particular only a minimum amount of leakage current then flows. The constant current source according to the invention can be designed in such a way that, when made in integrated-circuit technology, a low current of less than 100 nA is consumed.

In an advantageous embodiment of the constant current source according to the invention, the current balancing circuit is made up of a diode transistor and an associated current source transistor. Additionally, a resistor connects the collector of the diode transistor with its base and another resistor the output of the current balancing circuit, that is the collector of the associated current source transistor, with the collector of the diode transistor. With these two additional resistors, a better dynamic stability of the constant current source is obtained.

For the current balancing circuit made up of a diode transistor and associated current source transistor, a double collector transistor is used which means that if the circuit is integrated then only a small surface area is required.

Also, measures are provided for suppressing the tendency of the constant current source to oscillate by connecting an RC element to the base of the third transistor belonging to the band-gap reference voltage source.

BRIEF DESCRIPTION OF THE DRAWINGS

The invention will now be described and explained on the basis of embodiment examples in conjunction with the drawings. These show.

DESCRIPTION OF THE PREFERRED EMBODIMENTS

Figure 1:
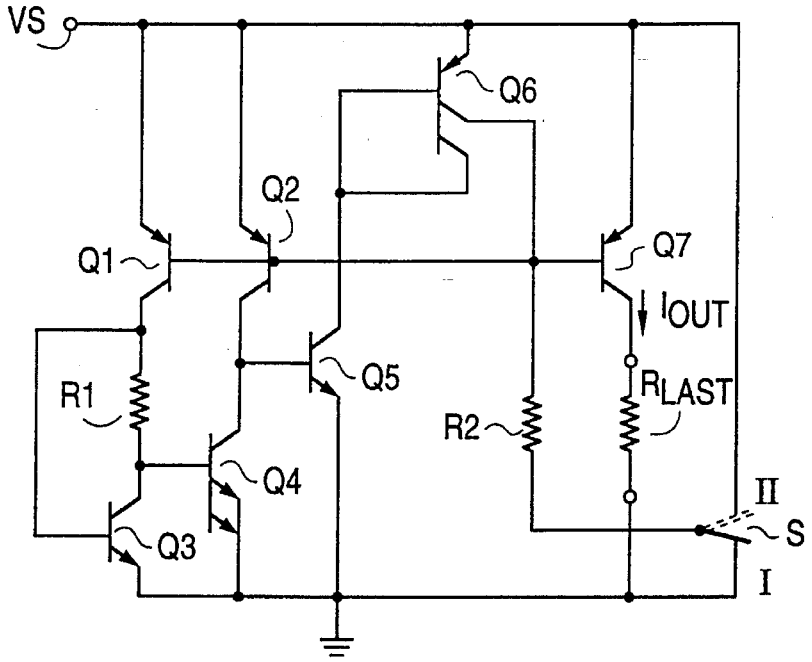
FIG. 1 shows an embodiment example of the constant current source according to the invention.

According to FIG. 1, a band-gap constant voltage source comprises a first npn transistor Q3, a second npn transistor Q4 and a third npn transistor Q5, where the second transistor Q4 has a larger emitter surface area than the first transistor Q3. The emitters of all three transistors Q3, Q4 and Q5 are at the reference potential of the circuit. The base electrode of the first transistor Q3 is connected via a first resistor R1 with its collector and also with the base of the second transistor Q4. The collector of the second transistor Q4 is connected to the base of the third transistor Q5 whose collector is connected with a current balancing circuit Q6. This current balancing circuit (Q6) consists of a diode transistor and an associated current source transistor and is in the form of a pnp double collector transistor. The base is joined with a collector terminal to form the input and the second collector terminal forms the output of the current balancing circuit. This output is connected to the base electrodes of three pnp current source transistors Q1, Q2 and Q7 whose emitter electrodes are directly at the operating potential $V_S$. The first current source transistor Q1 generates a current for the base of the first transistor Q3 and also its collector current, while the second current source transistor Q2 is connected through its collector with the collector terminal of the second transistor Q4. The third current source transistor Q7 acts as the output current source and conducts a constant output current $I_{out}$ into a load $R_{Last}$. Finally, at the output of the current balancing circuit Q6 a second resistor R2 is connected which in turn can be connected through a changeover switch S either with the reference potential of the circuit (position I) or with the operating potential $V_S$ of the circuit (position II).

Figure 4:
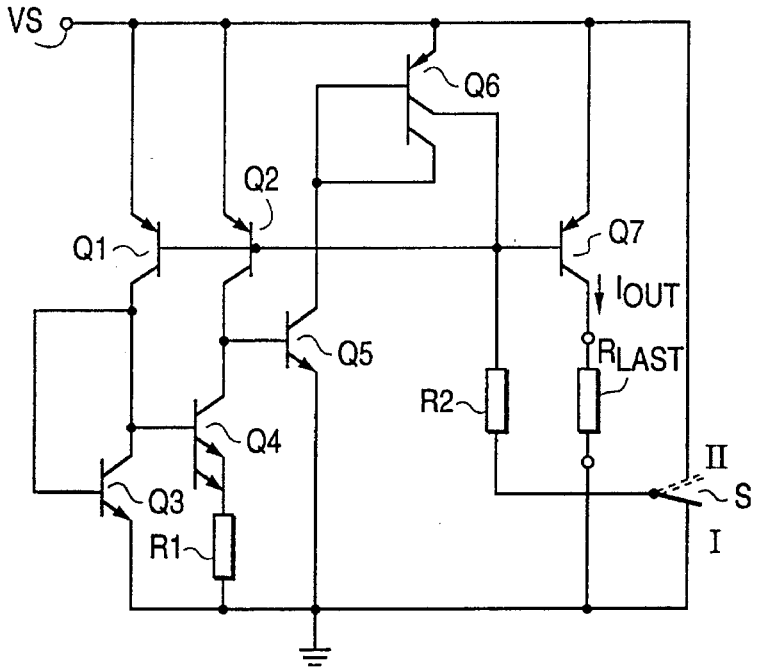
FIGS. 4 and 5 show alternate connections for the resistor R1 in the embodiments of FIGS. 1 and 2, respectively.

In FIG. 1, the band-gap cell is formed by the two transistors Q3 and Q4 and the resistor R1. The voltage difference caused by the different current densities of the emitter base surface areas of the two transistors Q3 and Q4 acts via the resistor R1. The same effect can be achieved with a resistor R1 which, in contrast to FIG. 1, is not placed in the collector branch of the transistor Q3 but in the emitter branch of the transistor Q4, the base of the transistor Q3 being connected directly with its collector as shown in FIG. 4. The two alternatives with respect to the connection of the resistor R1 are also demonstrated in FIGS. 1*a* and 1*b* in the patent publication DE 36 10 158 already mentioned at the outset.

In position I of the switch S, the circuit is started up by creating a collector current in transistors Q1 and Q2 by drawing the base currents of transistors Q1, Q2 and Q7 through this resistor R2. These collector currents of transistors Q1 and Q2 put into motion the regulating mechanism of the transistors Q3, Q4 and Q5 that determine the band-gap constant voltage source. This method of functioning together with the current balancing circuit Q6 and the controlled current sources Q1 and Q2 are explained below.

At very low currents, the voltage drop across the resistor R1 can initially be neglected. Since the currents generated by the current sources Q1 and Q2 are in themselves equal, but the ratio of the emitter surface areas of transistor Q4 to transistor Q3 is greater than one, transistor Q4 goes into the saturation state. Consequently, the transistor Q5 and the current balancing circuit Q6 carry no current and thus the current through the resistor R2 flows only in the bases of the current source transistors Q1, Q2 and Q7. As the current increases, the voltage drop becomes considerable and reduces the base-emitter voltage of the transistor Q4 compared with that of the transistor Q3. When the transistor Q4 comes out of the saturation state, current starts to flow through the transistor Q5 that continues to act against the current through the resistor R2 via the current balancing circuit Q6. The balancing point of the circuit is therefore reached and if the current through resistor R2 continues to rise the currents driven by the current sources Q1, Q2 and Q7 experience virtually no further change. The value of the resistor R2 determines the value of the supply voltage at which the output current $I_{out}$ is constant.

In position II of the switch S, the constant current source in accordance with the invention is inactive, i.e. the current source Q7 supplies no constant output current $I_{out}$. Because the bases of the current source transistors Q1, Q2 and Q7 have no residual voltages in this state, only minimal leakage currents flow.

When the constant current source according to FIG. 1 is switched on, the current flowing through the resistor R2 is compensated by the current through the current balancing circuit Q6. If this current through the resistor R2 fluctuates between wide limits, it becomes difficult to establish dynamic stability for all working points of the circuit.

Figure 2:
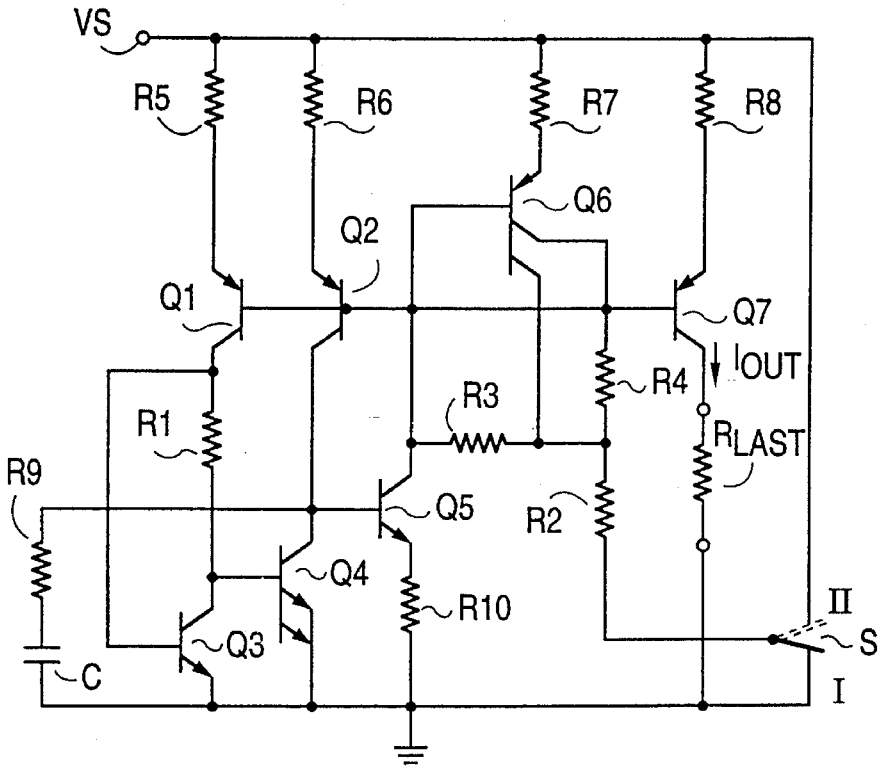
FIG. 2 shows another embodiment example of the constant current source according to the invention.

FIG. 2 shows an improved embodiment of a constant current source of the kind shown in FIG. 1. Essentially, this consists of the same components and therefore they have the same reference characters. Thus, a band-gap constant voltage source is provided made up of a first, second and third npn transistor Q3, Q4 and Q5, as well as the current sources Q1, Q2 and Q7 controlled by the current balancing circuit Q6. Finally, the second resistor R2 that serves to start the circuit can be connected via the changeover switch S either with the reference potential (position I) or with the operating potential ($V_S$) (position II).

Compared with the circuit shown in FIG. 1, the circuit shown in FIG. 2 has a third and fourth resistor R3 and R4. The third resistor R3 is connected between the base electrode of the double collector transistor Q6 and its collector electrode that belongs to the diode transistor. The fourth resistor R4 connects the other collector electrode of the current balancing circuit Q6 with the second resistor R2, of which the junction point with this fourth resistor R4 is taken to the first-mentioned collector electrode of the double-emitter transistor Q6.

Since a voltage supply range of 1.2 to 5.25 V is provided, the voltage drop across the second resistor R2 in the circuit shown in FIG. 1 would fluctuate between 0.6 and 4.65 V. This would lead to a fluctuation spread of the collector current in the third transistor Q5 of 1:7–8 which would have an adverse effect on the dynamic stability and a tendency of the circuit to oscillate would also have to be accepted. The two resistors R3 and R4 provided additionally according to FIG. 2 lead by contrast to a fluctuation spread at the transistor Q5 of only approx. 2:3, and therefore a considerably better dynamic stability is achieved over the entire above-mentioned voltage supply range.

Furthermore, emitter resistors R5, R6, R7 and R8 are assigned to the pnp transistors Q1, Q2, Q6 and Q7, and thus manufacturing tolerances and capacitive impairments are reduced.

In order to reduce the oscillation tendency of the constant current source according to the invention, there is additionally an RC element comprising a resistor R9 and a capacitor C arranged between the base of the third transistor Q5 and 1he reference potential of the circuit, and an emitter resistor R10 of the same transistor Q5 is provided.

Figure 3:
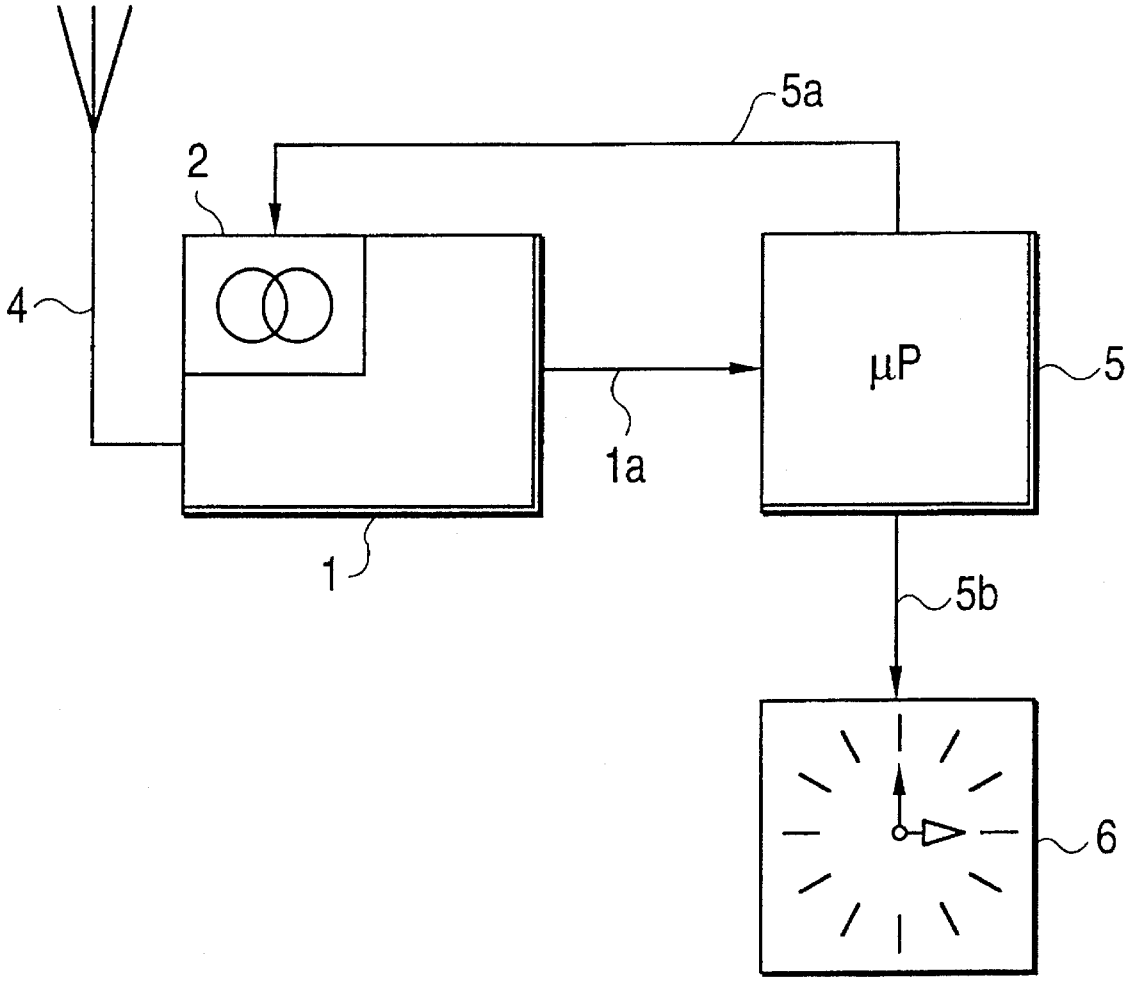
FIG. 3 is a block diagram of an embodiment example for a constant current source in accordance with FIGS. 1 or 2.

The constant current source according to the invention as shown in FIG. 2 can, for example, be used in a radio-controlled clock circuit as shown in FIG. 3. According to this, the radio-controlled clock consists of a receiver circuit 1 that includes the constant current source 2 according to the invention and which is connected with an antenna 4. This receiver circuit feeds the receiver information through a lead 1 a to a processor 5. Through a lead 5*a*, this processor causes the constant current source 2 to switch on or off, that is it assumes the function of the switch S shown in FIG. 2. Through a further lead 5*b*, the processor 5 controls the clock circuit 6 as such. In an application of this kind of the constant current source according to the invention, this constant current source draws 20 to 300 μA in the active state and no more than a mere 100 nA in the switched-off state, while the quartz circuit 6 draws 0.5 μA.

Figure 5:
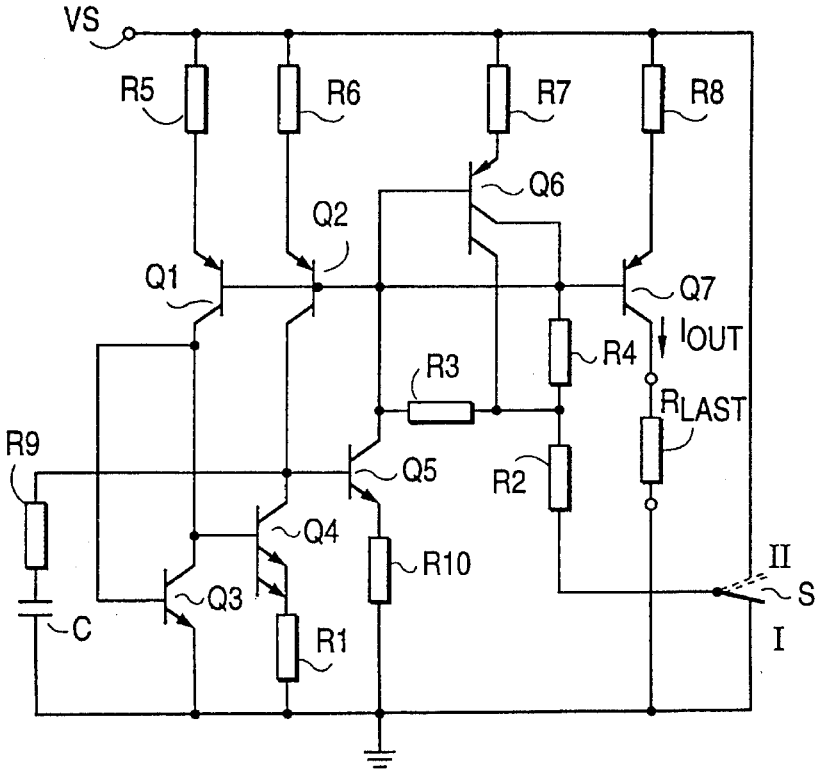

The embodiment examples shown in FIGS. 1 and 2 can also be made up with transistors of the opposite conductivity type. Finally, in the embodiment examples, the resistor R1 used in the band-gap cell can also be arranged in the emitter branch of the transistor Q4, in which case the base of the transistor Q3 is connected directly to its collector as shown in FIGS. 4 and 5.

What is claimed is:

1. Constant current source with a first and a second controlled current source, a first, a second and a third transistor each having a base, a collector and an emitter, and a first resistor, where the base of the second transistor is connected to the collector of the first transistor, the emitter of the first transistor is at a reference potential of the circuit, the first controlled current source is connected to the base of the first transistor, the second controlled current source is connected to the collector of the second transistor, which in turn is connected to the base of the third transistor, and where either the first resistor connects the base of the first transistor with its collector and the emitter of the second transistor is at the reference potential or the first resistor connects the emitter of the second transistor with the reference potential and the base of the first transistor is connected directly to its collector, wherein a current balancing circuit is provided with an input and an output, with said input being connected to the collector of the third transistor and with said output driving the first and second current sources and being connected via a second resistor and a changeover switch with the reference potential or with an operating voltage source and wherein a third current source controlled by the current balancing circuit supplies a constant output current.

2. Constant current source in accordance with claim 1, wherein the current balancing circuit comprises a diode transistor, having a base, a collector and an emitter, and a current source transistor, wherein a third and a fourth resistor are provided, wherein the third resistor connects the collector of the diode transistor with its base, wherein the fourth resistor is connected between the output of the current balancing circuit and the second resistor, and wherein the collector of the diode transistor of the current balancing circuit is connected to the junction point joining the second resistor with the fourth resistor.

3. Constant current source in accordance with claim 2, wherein a double collector transistor is used as said current balancing circuit.

4. Constant current source in accordance with claim 3, wherein an RC element is connected between the base of the third transistor and the reference potential.

* * * * *